US006647233B2

(12) United States Patent
Hiroki

(10) Patent No.: US 6,647,233 B2
(45) Date of Patent: Nov. 11, 2003

(54) IMAGE FORMING APPARATUS

(75) Inventor: Masashi Hiroki, Kanagawa-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/051,373

(22) Filed: Jan. 22, 2002

(65) Prior Publication Data

US 2003/0138269 A1 Jul. 24, 2003

(51) Int. Cl.[7] ..... G03G 15/00
(52) U.S. Cl. ..... 399/228; 399/110
(58) Field of Search ..... 399/228, 107, 399/110

(56) References Cited

U.S. PATENT DOCUMENTS 4,996,554 A * 2/1991 Kiyoharu ..... 355/406
5,138,398 A * 8/1992 Yamada ..... 399/226

FOREIGN PATENT DOCUMENTS

| | | | |
|---|---|---|---|
| EP | 430 666 | * | 1/1995 |
| JP | 2 64577 | | 3/1990 |
| JP | 2-285372 | | 11/1990 |
| JP | 4-175781 | * | 6/1992 |
| JP | 4-284471 | * | 10/1992 |

OTHER PUBLICATIONS

U.S. patent application Ser. No. 09/898,481, Hiroki, filed Jul. 5, 2001.

U.S. patent application Ser. No. 09/953,617, Hiroki et al., filed Sep. 17, 2001.

* cited by examiner

*Primary Examiner*—Quana M. Grainger
(74) *Attorney, Agent, or Firm*—Foley & Lardner

(57) ABSTRACT

An image forming apparatus of this invention is composed of: an image carrier; a latent image forming unit to form a latent image on the image carrier, a developing device having a developing unit for supplying a developer to the latent image formed on the image carrier by sliding in the direction to contact/separate to/from the image carrier in a main body; a positioning device to maintain the developing device in the operable state for development of the image in the main body; and a driving device to connect/separate the developing device to/from the positioning device by applying load in the sliding direction to the developing device in the main body and after connecting the developing device to the positioning device, moving the developing device in the direction to leave from the image carrier. After connecting/separating the developing device to/from the positioning device, the load applied to the developing device by the driving device is cancelled.

17 Claims, 7 Drawing Sheets

IMAGE FORMING APPARATUS

BACKGROUND OF THE INVENTION

1. Field of the Invention

The present invention relates to image forming apparatus as electro-photographic apparatus, printer, etc. equipped with developing devices for forming developer images on a photosensitive body by bringing developing rollers to contact/separate to/from a photosensitive body.

2. Description of the Related Art

In an image forming apparatus such as a color copier, a color printer, etc. for obtaining color images according to an electro-photographic system, in order to obtain a full-color image using plural toners in different colors such as yellow (Y), magenta (M), cyan (C) and black (BK), an apparatus has been developed, wherein four developing devices filled with color toners corresponding to colors of, for example, a latent image that is formed on a belt-shape photosensitive body are moved successively in the direction of a photosensitive body and a latent image is developed by bringing developing rollers to contact the photosensitive body and after toner images in respective colors are overlapped each other on the photosensitive body or an intermediate transfer body, the overlapped toner images are transferred on a recording paper collectively.

In an image forming apparatus, wherein developing devices are taken out of the main body of the apparatus for supplying toners and reinstalled in the main body after supplying toners, a technology to take out and replace the developing devices through the top of the main body of the apparatus by moving them in the vertical direction to the photosensitive body is disclosed in Japanese Patent Publication No. 10-58754. Further, a technology to remove/install developing devices through the side frame of the main body by moving them in the horizontal direction to the photosensitive body is disclosed in Japanese Patent Publication No. 2-64577.

However, in the case of the former technology described above, when a copier function is provided, there are an optical device for reading original documents, an automatic document feeder, etc. on the top of the main body and the opening/closing of the main body cover is impeded and therefore, this technology is not suited for use. Further, in the case of the latter technology, when an main body of an apparatus is installed at near a corner of an office or there are materials placed around the main body, the opening/closing of the side frame would be impeded and further, in the case of a system with a finish device provided adjacent to the main body in order for the space saving of the main body, the opening/closing would be impeded.

That is therefore desired that when the developing devices are taken out of the main body of an image forming apparatus, they can be taken out easily and smoothly without impeding the opening/closing of the frame for various restrictions and operability at the maintenance of the developing devices can be achieved.

SUMMARY OF THE INVENTION

It is an object of this invention to provide an image forming apparatus wherein developing devices are removed and installed from the main body of the image forming apparatus easily and smoothly and operability at the time of maintenance can be improved.

According to embodiments of this invention, an image forming apparatus is provided. This image forming apparatus comprises an image carrier; a latent image forming unit to form a latent image on the image carrier; a developing device having a developing unit to supply a developer to the latent image by sliding in the direction to contact/leave to/from the image carrier in a main body; a positioning device to maintain the developing device in the operable state in the main body; and a driving device to move the developing device in the direction to contact/leave to/from the image carrier after the developing device is connected to the positioning device by connecting and leaving the developing device to the positioning device by applying a load to the developing device in the sliding direction in the main body. This image forming apparatus is characterized in that a load applied to the developing device is cancelled by he driving device after the developing device is connected/removed to/from the positioning device.

Further, according to the embodiments of this invention, an image forming apparatus is provided. This image forming apparatus comprises a photosensitive body; a latent image forming unit to form a latent image on the photosensitive body; a developing device having a developing roller to supply a developer to the latent image by sliding in the direction to contact/leave the photosensitive body in a main body; a positioning member to maintain the developing device in the operable state to develop in the main body; and a driving roller having an acting unit provided around a shaft for sliding the developing device while in contact with the developing device and a canceling unit which is formed by partially cutting the acting unit and not in contact with the developing device for connecting and disconnecting the developing device to the positioning member by applying a load in the sliding direction to the developing device in the main body by rotating the shaft in the state of the acting unit in contact with the developing device and sliding the developing device connected to the positioning member in the direction to contact/leave to/from the photosensitive body. This image forming apparatus is characterized in that after the developing device is connected/separated to/from the positioning member, the canceling unit is brought to face the developing device by rotating the shaft.

Further, according to the embodiments of this invention, an image forming apparatus is provided. This image forming apparatus comprises a photosensitive body; an image forming unit to form a latent image on the photosensitive body; a developing device having a developing roller to supply a developer to the latent images by sliding in the direction to contact/separate to/from the photosensitive body in a main body; a positioning member to maintain the developing device in the operable state for development in the main body; a housing case to house the developing device; and a housing case moving device that apply load in the sliding direction to the housing case by contacting them to connect and remove the developing device to/from the positioning member and after connecting the developing device to the positioning member, bring the developing device to contact/separate to/from the photosensitive body.

DETAILED DESCRIPTION OF THE INVENTION

Figure 1:
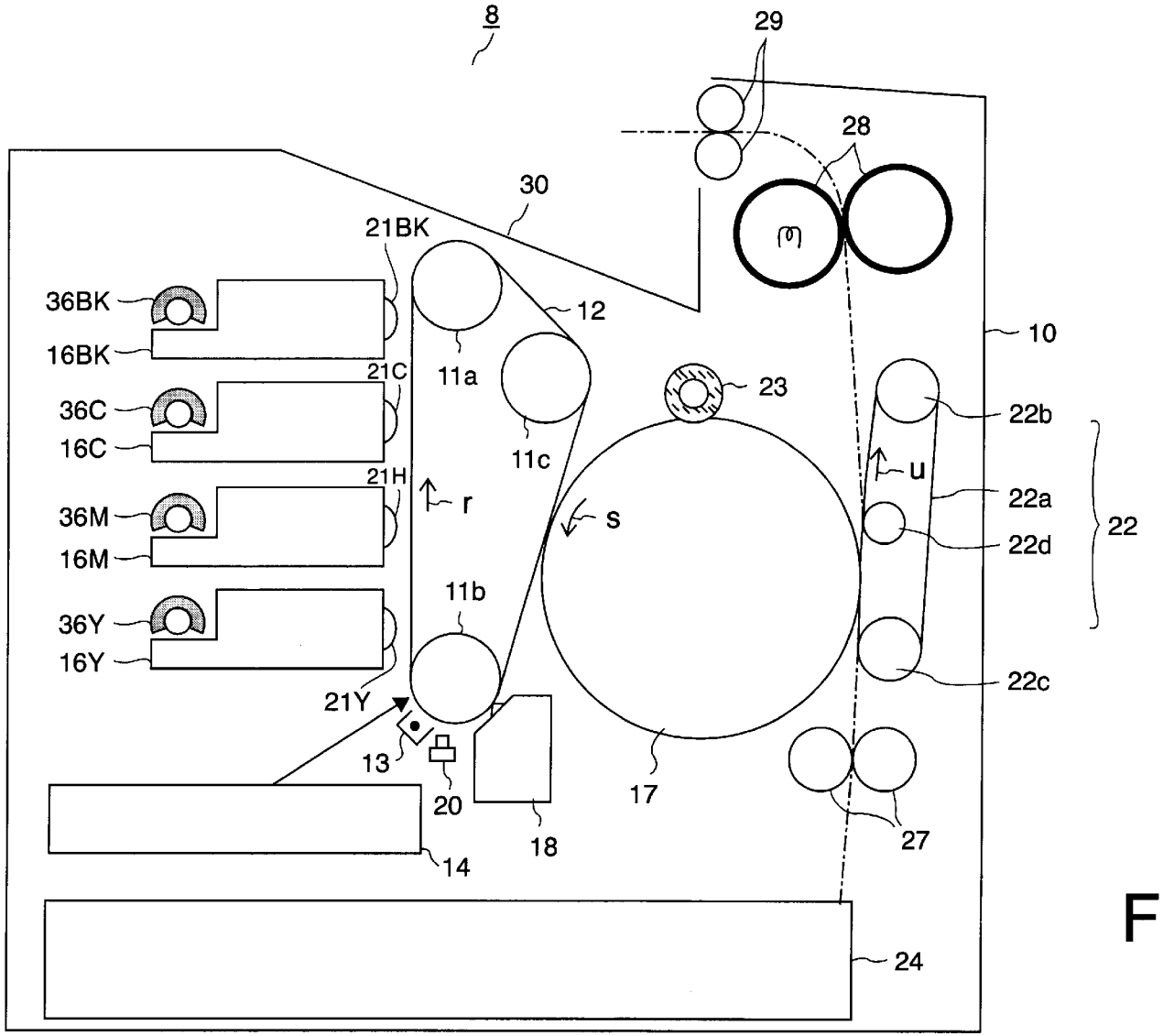
FIG. 1 is a diagram for schematically showing the structure of an image forming apparatus of a first embodiment of this invention.
Figure 2:
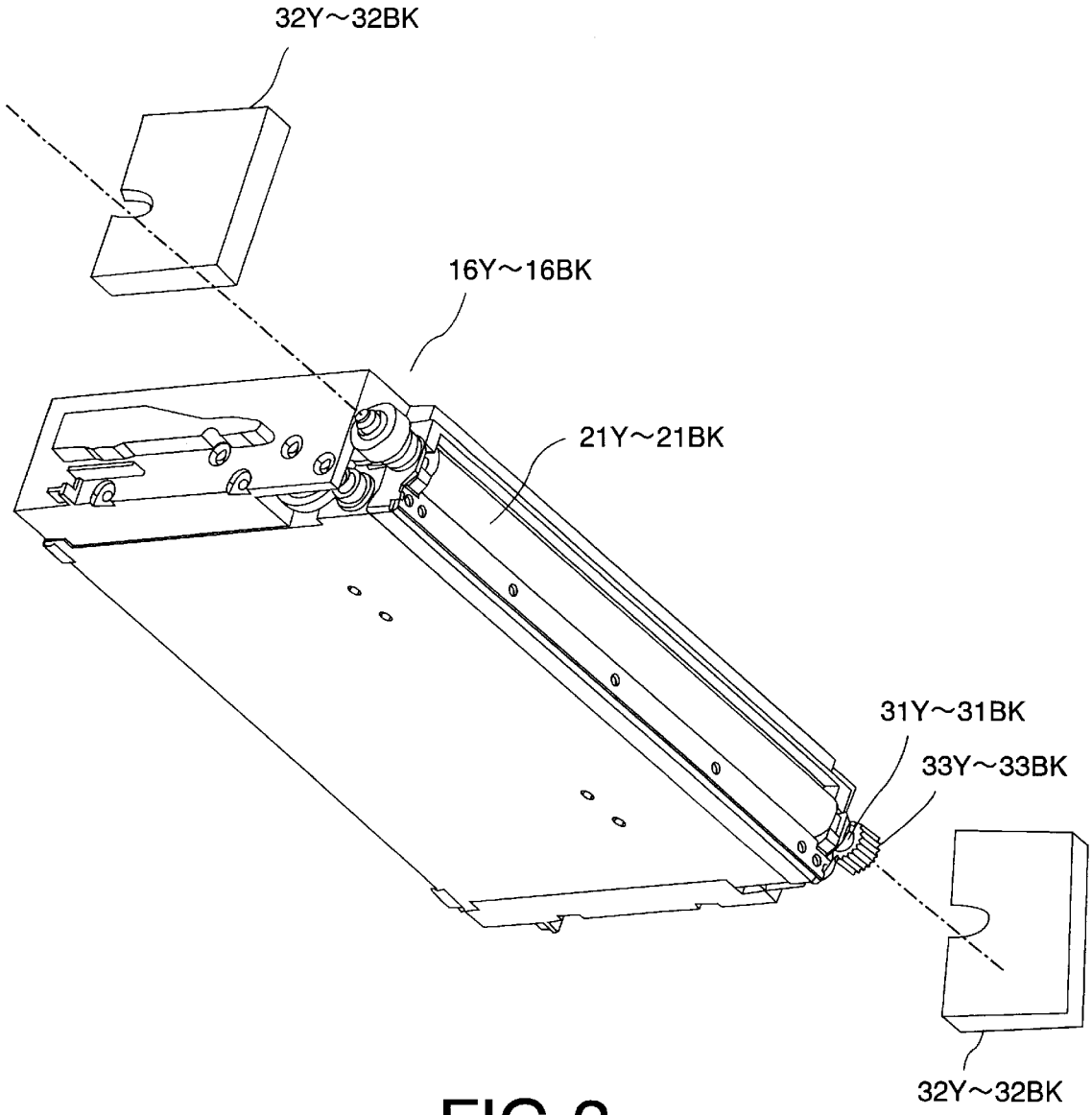
FIG. 2 is a perspective view showing a developing device of the first embodiment of this invention.

Preferred embodiments of this invention will be described in detail referring to the attached drawings. FIG. 1 is a schematic block diagram showing an image forming apparatus 8 such as a color printer, etc. in a first embodiment of this invention. In a main body 10 of the image forming apparatus 8, there are provided a driving roller 11*a*, a driven roller 11*b*, and a photosensitive belt 12. This belt 12 is an image carrier, put over a tension roller 11*c*, its base plate is coated with a photo-sensitive agent, and its back surface is grounded at 0V.

Around the photosensitive belt 12, there are arranged a charger 13 which uniformly charges the photosensitive belt 12 to about −700V successively according to traveling in the arrow direction r, a laser writing unit 14 which is a latent image forming unit for forming a latent image on the charged photosensitive belt 12, developing devices 16Y, 16M, 16C and 16BK which are filled with yellow (Y), magenta (M), cyan (C) and lack (BK) 4 color developers, respectively, an intermediate transfer drum 17 to which +1 kV bias voltage is applied, a cleaner 18 and a charge eliminating lamp 20.

The laser writing unit 14 forms a latent image on the photosensitive belt 12 by applying laser light corresponding to each color writing signal at a position supported by the driven roller 11*b* according to image data input from an external computer terminal, etc. Around the intermediate transfer drum 17, there are arranged a secondary transfer unit 22 to which +2–3 kV bias voltage is applied for secondarily transferring a toner image transferred from the photosensitive belt 12 according to the rotation in the arrow direction s and a brush shaped drum cleaner 23 to which +1.5 kV voltage is applied. The secondary transfer unit 22 has a secondary transfer belt 22*a* that is put over a driving roller 22*b*, a driven roller 22*c* and a tension roller 22*d* and rotated in the arrow direction u.

At the lower part of the main body 10 of the apparatus, a paper cassette 24 containing recording paper (not shown) is arranged. Between the paper cassette 24 and the secondary transfer unit 22, an aligning roller pair 27 is provided for synchronizing the leading edge of a recording paper take out from the paper cassette to the leading edge of a toner image on the intermediate transfer drum 17. Further, at the downstream side of the secondary transfer unit 22, a heat roller 28, a paper discharge roll pair 29 and a paper discharging unit 30 are arranged.

The developing devices 16Y–16BK have developing rollers 21Y, 21M, 21C and 21BK in 18 mm diameter, which are developing units to develop a latent image by contacting with the photosensitive belt 12. The developing devices 16Y–16BK are connected/removed to/from the front side of the main body of the apparatus when supplying developers.

Developing roller shafts 31Y–31BK are projected to both sides of the developing rollers 21Y–21BK. The developing roller shafts 31Y–31BK are guided by developing roller shaft guides 32Y–32BK that are positioning devices provided at the main body 10 side for making the positioning of the developing devices 16Y–16BK to the photosensitive belt 12. Further, at the ends of the developing roller shafts 31Y–31BK, developing roller gears 33Y, 33M, 33C and 33BK are provided to transmit the driving force of the developing device driving system (not shown) transmitted form a main motor (not shown) at the main body 10 of the apparatus.

On the backs of the developing devices 16Y–16BK, not the supporting side of the developing rollers 21Y–21BK, boards 34Y–34BK are mounted for slide moving the developing devices 16Y–16BK.

Above the boards 34Y–34BK, driving rollers 36Y–36BK which are supported at the main body 10 side are provided. The driving rollers 36Y–36BK form rubber rollers 38Y–38BK around the shafts 37Y–37BK, which are acting portions of shafts 37Y–37BK by cutting a part of them. Notched portions 40Y–40BK of the rubber rollers 38Y–38BK form the releasing portions of the driving rollers 36Y–36BK. That is, when the rubber rollers 38Y–38BK of the driving rollers 36Y–36BK slide the boards 34Y–34BK back and forth in the driven direction of the rubber rollers 38Y–38BK by frictional force when rotating by contacting the boards 34Y–34BK. Further, when the notched portions 40Y–40BK of the driving rollers 36Y–36BK come to face the boards 34Y–44BK, the boards 34Y–34BK are released from the drive of the driving rollers 36Y–36BK and become the free state.

Next, a full-color image forming process by the image forming apparatus 8 will be described. Before the image forming process starts, the top portions of the rubber rollers 38Y–38BK which partially cut the driving rollers 36Y–36BK rotating in the arrow direction v are in contact with the boards 34Y–34BK of the developing devices 16Y–16BK. The developing devices 16Y–16BK are in the operable state for development, and the developing rollers 21Y–21BK positioned by the developing roller shaft guides 32Y–32BK are in the ready state separated from the photosensitive belt 12 by about 1.0 mm.

Figure 4:
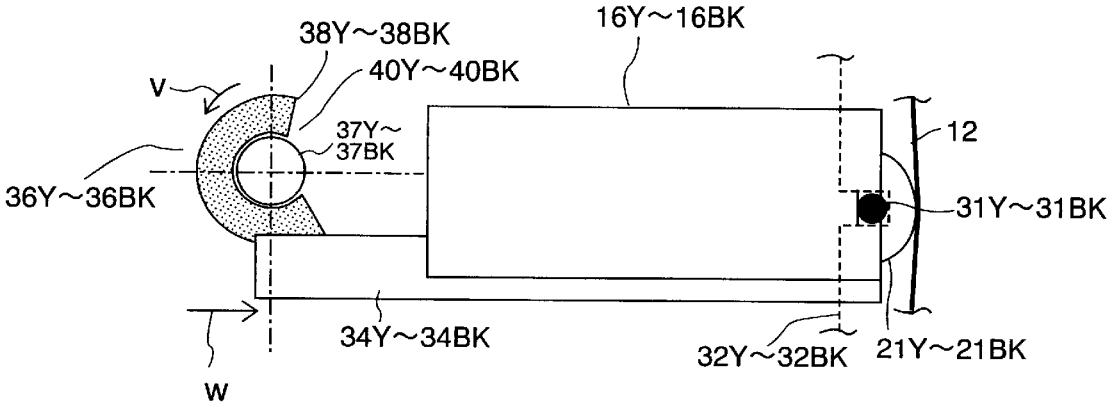
FIG. 4 is a diagram for schematically explaining the developing state of the developing device of the first embodiment of this invention.

Then, when the image forming process is started, the driving roller 36Y for moving the yellow (Y) developing device 16Y filled with yellow (Y) toner is first rotated and driven by a specified angle in the arrow direction v by a driving motor (not shown). As a result, the board 34Y is slid in the arrow direction w by the frictional force of the rubber roller 38Y as shown in FIG. 4, and the yellow (Y) developing device 16Y moves the developing roller shaft 31Y in the arrow direction w in the state guided by the developing roller shaft guide 32Y so that the developing roller 21Y contacts the photosensitive belt 12 and bites into it by about 0.5 mm.

In this state, the photosensitive belt 12 is run in the arrow direction r and uniformly charged to −700V by the charger 13 with the rotation of the belt. Then, laser beam corresponding to an yellow image signal out of image signals separated into yellow, magenta, cyan and black by the laser writing unit 14 is applied. Thus, a latent image of an yellow image of laser light applied portion at about −100V is formed on the photosensitive belt 12. Then, the yellow latent image formed on the photosensitive belt 12 is developed by the developing roller 21 while passing through the nip portion between the developing roller 21Y and the photosensitive belt 12 and an yellow toner image is formed on the photosensitive belt 12.

Then, the photosensitive belt 12 reaches the intermediate transfer drum 17 to which about +1 BKV transfer bias is applied and intermediately transfers an yellow toner image electrostatically on the intermediate transfer drum 17. After transferring, the photosensitive belt 12 is cleaned by removing residual toner by the cleaner 18 and the charge on the surface is eliminated by the charge eliminating lamp 20.

Figure 3:
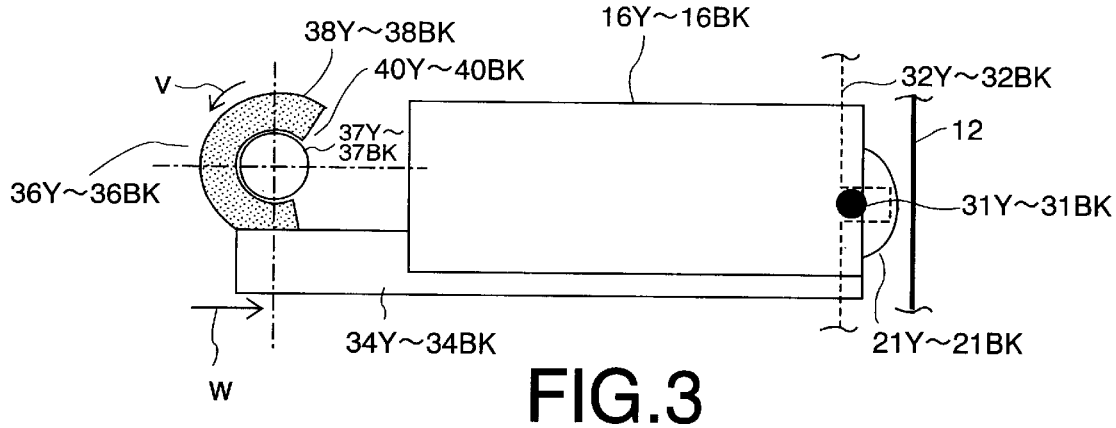
FIG. 3 is a diagram for schematically explaining the ready state of the developing device of the first embodiment of this invention.

On the other hand, after completing the yellow toner image forming process, the driving roller 36Y of the developing device 16Y is rotated and driven in the direction reverse to the arrow direction v to the position shown in FIG. 3 and stops there. As a result, with the sliding of the board 34Y in the direction reverse to the arrow direction w by the frictional force of the rubber roller 38Y, the yellow developing device 16Y is slid in the direction reverse to the arrow direction w, the developing roller 21Y is separated from the photosensitive belt 12 and returned to the ready state.

Hereafter, the magenta, cyan and black toner image forming processes are repeated successively in the same manner as in the yellow image forming process and the yellow (Y), magenta (M), cyan (C) and black (BK) toner images are transferred and laminated successively on the intermediate transfer drum 17 and a full-color toner image is formed on the intermediate transfer drum 17.

The full-color image in the yellow (Y), magenta (M), cyan (C) and black (BK) colors formed on the intermediate transfer drum 17 is transferred on a recording paper that is taken out from the paper cassette 24 by the secondary transfer unit 22 to which +2–3 BKV bias voltage is applied and conveyed synchronously with the full-color toner images on the intermediate transfer drum 17. Then, the full-color image transferred on the recording paper is fixed by the heat roller 28 and discharged on the paper receiving tray 30 via the paper discharging roller 29. Thus, the full-color image is completed on the recording paper. During this period, residual toners remained on the intermediate transfer drum 17 are removed by the drum cleaner to which +1.5 BKV bias voltage is applied and the intermediate transfer drum 17 becomes ready for the intermediate transfer.

The developer supply operation of anyone of the developing devices 16Y–16BK while the image forming process is repeated as shown above will be described below. When developers are supplied to the developing devices 16Y–16BK, for example, when a developer is supplied to the yellow developing device, first open the front cover (not shown) of the main body 10 and then, manually rotate the yellow driving roller 36Y that is in the ready state as shown in FIG. 3 in the direction reverse to the arrow direction V.

Figure 5:
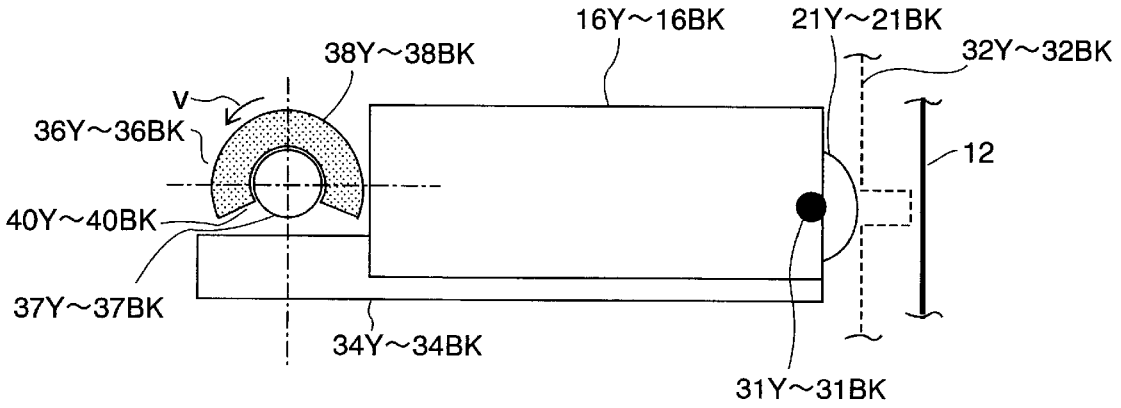
FIG. 5 is a diagram schematically showing the connection/disconnection of the developing device to/from the main body of the apparatus of the first embodiment of this invention.

Thus, the board 34Y is slid in the direction reverse to the arrow direction w by the frictional force of the rubber roller 38Y and the end of the rubber roller 38Y stops at the position that is out of the board 34Y as shown in FIG. 5. At this time, the notched portion 40Y of the driving roller 36Y is opposite to the board 34Y. Further, the developing device 16Y is further slid and moved in the direction reverse to the arrow direction w from the ready state and therefore, the developing roller shaft 31Y gets out of the developing roller shaft guide 32Y and load from the driving roller 36Y is no longer applied and is placed in the free state in the main body 10.

Hereafter, pull out the developing device 16Y to the front side from the main body 10 along a guide rail (not shown) and after supplying a developer, return it into the main body 10. Then, rotate the driving roller 36Y rotated manually in the arrow direction V from the free state shown in FIG. 5. After the top of the rubber roller 38Y contacts the boards 34Y–34BK with the rotation of the driving roller 36Y, the board 34Y is slid in the arrow direction w by the frictional force of the rubber roller 38Y, and the developing roller shaft 31Y reaches the ready state shown in FIG. 3, wherein it is inserted into the developing roller shaft guide 32Y.

At the point of time when this ready state is reached, the driving roller 36 stops to rotate, the front cover (not shown) is closed, the developer supply operation is terminated and the developing device 16Y becomes ready for the next image forming process. Further, for the magenta (M), cyan (C) and black (BK) developing devices 16M–16BK, the pull-out and return operations from/to the main body 10 are carried out in the same manner as described above.

According to this first embodiment, as the developing devices 16Y–16BK which are slid and moved in the direction of the photosensitive belt 12 can be pulled out of and connected to the main body through its front side, the opening/closing of the cover of the main body 10 for pulling out the developing devices therefrom are not impeded irrespective of the installed position of the image forming apparatus 8 and even when a finish device is used. Accordingly, the installing position is not restricted and the space saving can be achieved and furthermore, it is suited to provide an optical device above the image forming apparatus 8 or use for composite apparatus equipped with a finish device, etc.

Further, when the developing devices 16Y–16BK are pulled out of or connected to the main body 10, the driving rollers 36Y–36BK are rotated and the notched portions 40Y–40BK of the driving rollers 36Y–36BK are faced to the boards 34Y–34BK. Thus, the developing devices 16Y–16BK are not applied with any load in the man body 10 and are in the load free state. Accordingly, a user is able to connect/separate the developing devices 16Y–16BK only by sliding the developing devices 16Y–16BK in the front direction along the guide rails (not shown) and thus, the developing devices can be smoothly connected/separated and operability is improved.

Next, a second embodiment of this invention will be described. In this second embodiment, the developing devices are slid and moved by moving the boards using driving gears instead of the driving rollers in the first embodiment. Accordingly, in this second embodiment, the same component elements as those described in the first embodiment will be assigned with the same reference numerals and the detailed explanation thereof will be omitted.

Figure 6:
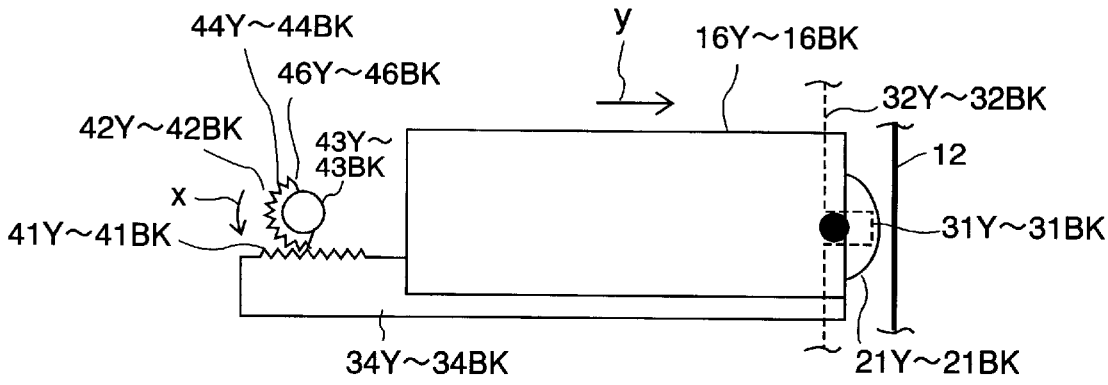
FIG. 6 is a diagram for schematically explaining the ready state of the developing device in a second embodiment of this invention.

As shown in FIG. 6, on the surfaces of the boards 34Y–34BK of the developing devices 16Y–16BK, racks 41Y–41BK are mounted. Above the boards 34Y–34BK, driving gears 42Y–42BK that are driving devices are provided. The driving gears 42Y–42BK are composed of partially cut gears 44Y–44BK which are acting portions formed around gear shafts 43Y–43BK. The notched portions 46Y–46BK of the gears 44Y–44BK form the releasing portions of the gears 42Y–42BK.

That is, the gears 44Y–44BK of the driving gears 42Y–42BK reciprocate the boards 34Y–34BK mechanically in the driven direction with the gears 44Y–44BK by rotating while meshing with the racks 41Y–41BK on the boards 34Y–34BK. Further, when the notched portions 46Y–46BK of the driving gearss 42Y–42BK come to face the boards 34Y–34BK, the racks 41Y–41BK are released from the drive of the driving gears 41Y–41BK and become the free state.

In the developing devices 16Y–16BK in the main body 10, the racks 41Y–41BK on the boards 34Y–34BK mesh with the top portions of the gear 44Y–44BK of the driving gears 42Y–42BK, the developing roller shafts 32Y–32BK are inserted into the developing roller shaft guides 32Y–32BK, and the developing rollers 21Y–21BK are in the ready state separated from the photosensitive belt 12 by about 1.0 mm.

Figure 7:
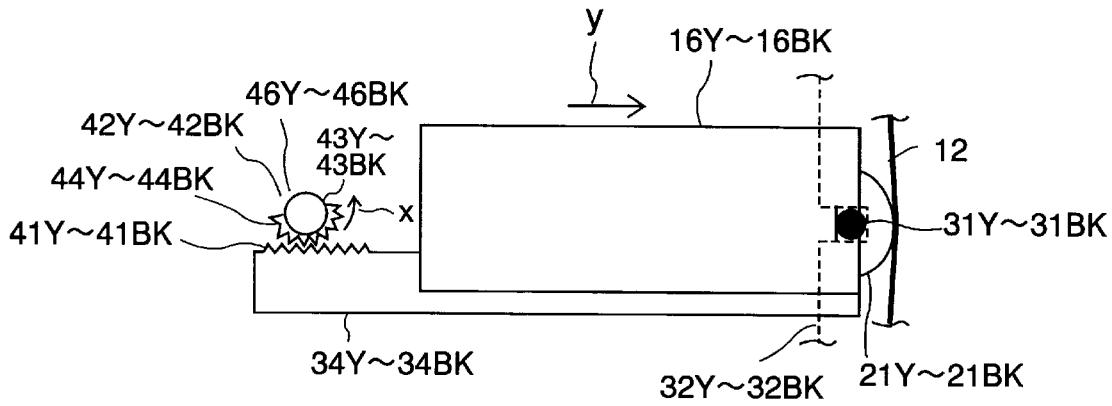
FIG. 7 is a diagram for schematically explaining the developing state of the developing device in the second embodiment of this invention.

After the image forming process is started, when the development is made by the yellow (Y) developing device 16Y filled with an yellow (Y) toner, the driving gear 42Y is rotated and driven at a specified angle in the arrow direction x by a driving motor (not shown). As a result, the board 34Y is slid in the arrow direction y together with the rack 41Y that is meshed with the gear 44Y as shown in FIG. 7. The developing roller shaft 31Y of the yellow (Y) developing device is slid and moved in the arrow direction y in the state guided by the developing roller shaft guide 32Y, the developing roller 21Y is brought in contact with the photosensitive belt 12 so as to bite into it by about 0.5 mm, and the development becomes ready.

Further, after completing the development, the driving gear 42Y is rotated and driven in the direction reverse to the arrow direction x to the position shown in FIG. 6 and stopped there. As a result, the board 34Y is slid in the direction reverse to the arrow direction y together with the rack 41Y meshed with the gear 44Y, the yellow developing device 16Y is slid in the direction reverse to the arrow direction y, the developing roller 21Y is separated from the photosensitive belt 12 and the developing device 16Y returns to the ready state.

Figure 8:
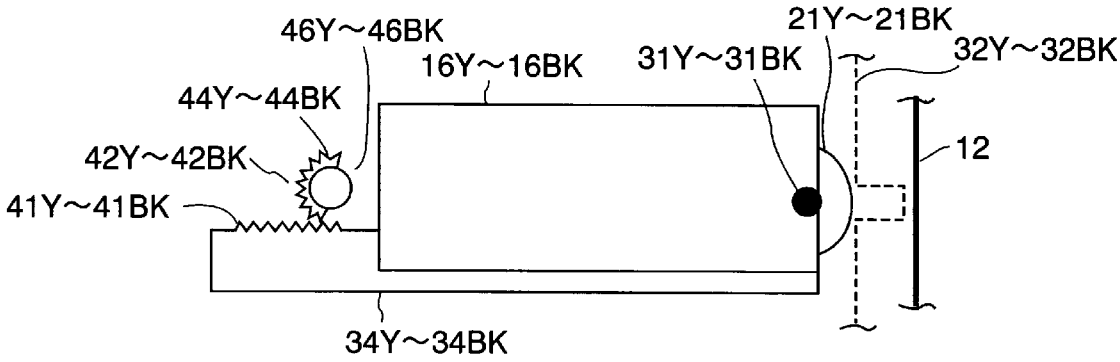
FIG. 8 is a diagram for schematically explaining the installation/removal of the developing device from the main body of the second embodiment of this invention.
Figure 9:
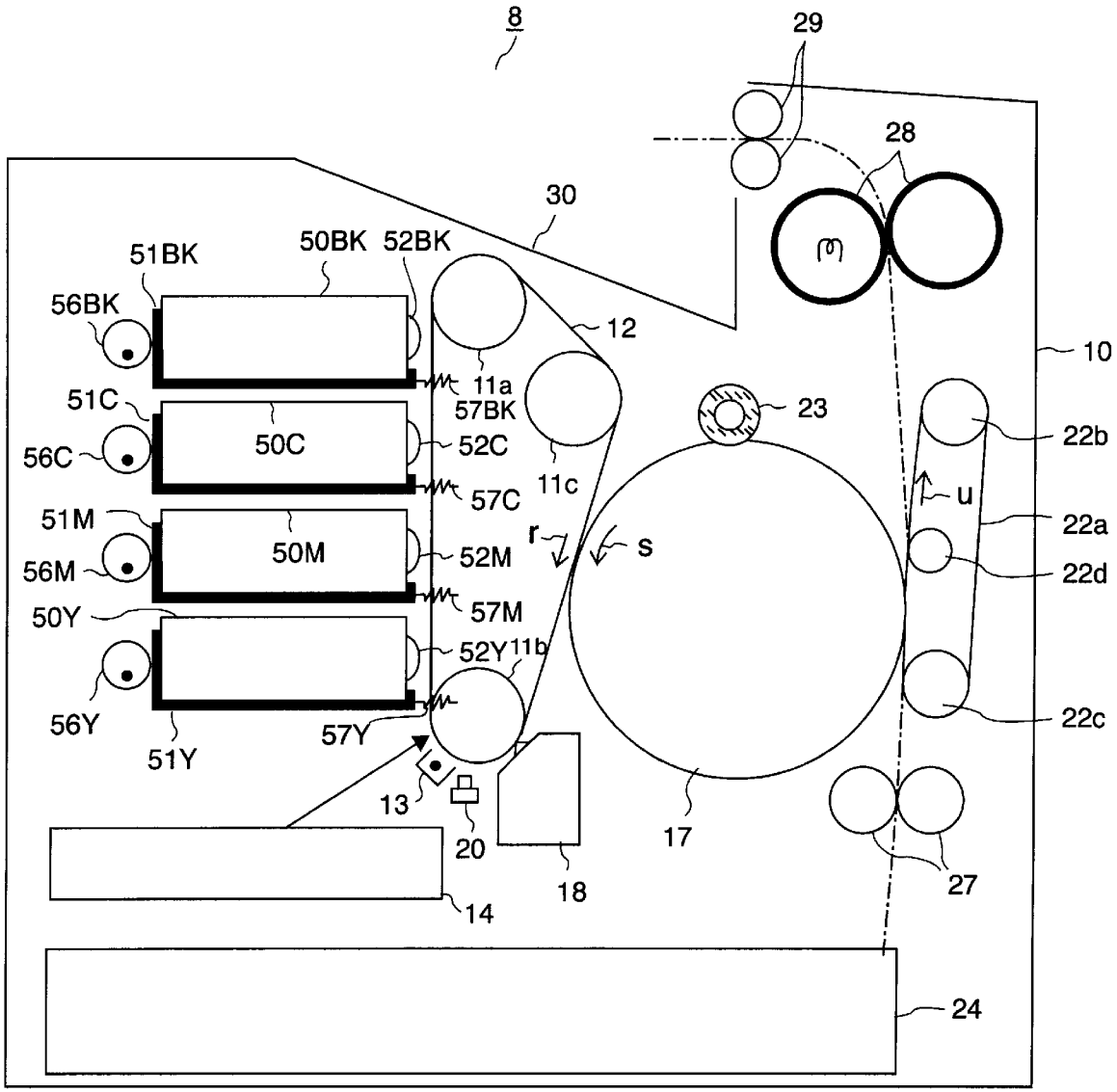
FIG. 9 is a diagram schematically showing the structure of an image forming apparatus of a third embodiment of this invention.

When developers are supplied to the developing devices 16Y–16BK, manually rotate the driving gears 42Y–42BK which are in the ready state as shown in FIG. 6 in the direction reverse to the arrow direction x after opening the front cover (not shown) of the main body 10. As a result, the boards 34Y–34BK are slid together with the racks 41Y–41BK that are meshed with the gears 44Y–44BK in the direction reverse to the arrow direction y by the mechanical force of the rotations of the gears 44Y–44BK, and the tops of the gears 44Y–44BK stop at the position off the racks 41Y–41BK as shown in FIG. 8. At this time, the notched portions 46Y–46BK of the driving gears 42Y–42BK are facing the boards 34Y–34BK. Further, the developing device 16Y is further slid in the direction reverse to the arrow direction y from the ready state and therefore, the developing roller shafts 31Y–31BK come off the developing roller shaft guides 32Y–32BK and become the free state in the main body 10 as there is no load from the driving gear 42Y–42BK.

Hereafter, pull out the developing devices 16Y–16BK to the front side from the main body 10 along the guide rails (not shown), and return them in the main body 10 after supplying developers. Then, manually rotate the driving gears 42Y–42BK in the arrow direction x from the free state shown in FIG. 8. By the rotation of the driving gears 42Y–42BK, the top portions of the gears 44Y–44BK contact and mesh with the lacks 41Y–41BK, and by the further rotation of the gears 44Y–44BK, the board 34Y is slid in the arrow direction y. Thereafter, at the point of time when the developing roller shafts 31Y–31BK reach the ready state shown in FIG. 6 wherein they are inserted into the developing roller shaft guides 32Y–32BK, the rotation of the driving gears 42Y–42BK stop, the front cover (not shown) is closed and the developer supply operation is terminated.

According to this second embodiment, likewise the first embodiment described above, the developing devices 16Y–16BK that are moved in the direction of the photosensitive belt 12 can be taken out of and connected through the front side of the main body 10 and therefore, the opening/closing of the cover are not impeded when removing/connecting and also, the installing position is not restricted. Therefore, the space saving can be made and furthermore, this apparatus is suited for use in a composite apparatus, etc. Further, the developing devices 16Y–16BK are made free in the main body 10 by bringing the notched portions 46Y–46BK of the driving gears 42Y–42BK to face the boards 34Y–34BK when removing/connecting the developing devices 16Y~16BK from/to the main body 10. Thus, it is possible to smoothly remove/connect the developing devices 16Y–16BK and improve operability only by sliding the developing devices 16Y–16BK along the guide rails (not shown) in the front direction.

Next, a third embodiment of this invention will be described. In this third embodiment, the developing devices shown in the first embodiment are housed in the housing case in the main body of the image forming apparatus and the developing rollers are brought in contact with or separated from the photosensitive belt by sliding the developing devices by moving the housing case. Therefore, in this third embodiment, the same component elements explained in the first embodiment are assigned with the same reference numerals as explained in the first embodiment and the detailed explanation thereof will be omitted.

Developing devices 50Y–50BK filled with yellow (Y), magenta (M), cyan (C) and black color developers, respectively are supported by housing cases 51Y–51BK in a tray shape, which are supporting members in the main body 10 and arranged at the developing positions around the photosensitive belt 12. Further, the developing devices 50Y–50BK are supported slidably in the front direction of the main body 10 in the housing cases 51Y–51BK. Developing roller shafts 53Y–53BK at both sides of developing rollers 52Y–52BK of the developing devices 50Y–50BK are guided by the developing roller shaft guides 32Y–32BK and make the positioning of the developing devices 50Y–50Bk to the photosensitive belt 12.

Eccentric cams which are the first forcing members for sliding the developing devices 50Y–50BK via the housing cases 51Y–51BK which are slid along frames 55Y–55BK in the main body 10 are in contact with the backs of the housing cases 51Y–51BK. Further, at the photosensitive belt 12 sides of the housing cases 51Y–51BK, springs 57Y–57BK, which are second forcing members comprising driving devices together with the eccentric cams 56Y–56BK and force the housing cases 51Y–51BK to separate from the photosensitive belt 12 are mounted. By the driving force of the eccentric cams 56Y–56BK and the compression force of the springs 57Y–57BK, the developing devices 50Y–50BK are slid and moved via the housing cases 51Y–51B.

Figure 10:
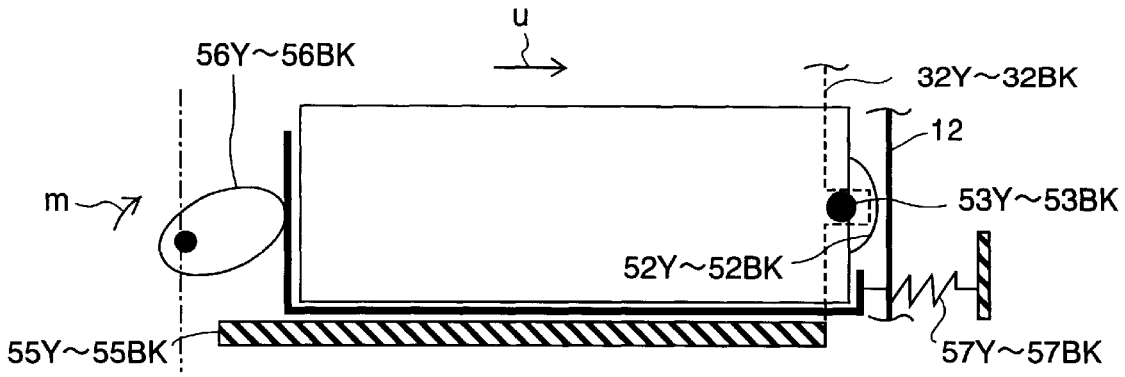
FIG. 10 is a diagram for schematically explaining the ready state of he developing device of the first embodiment of this invention.
Figure 11:
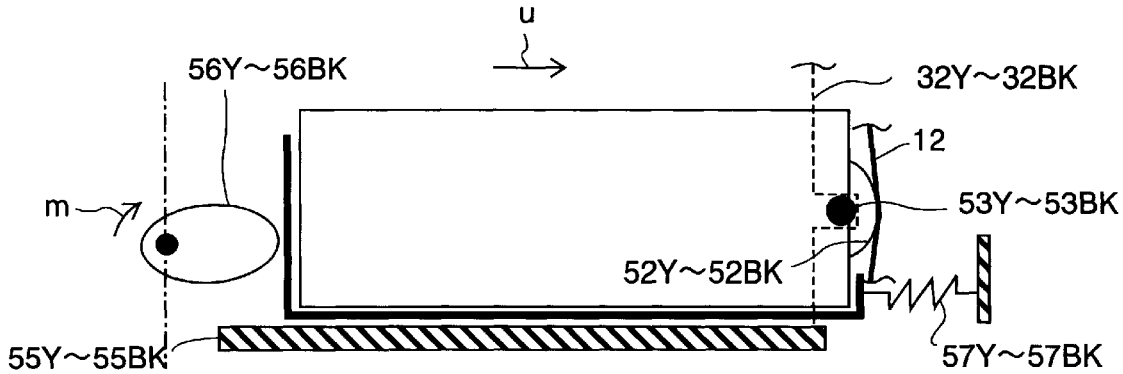
FIG. 11 is a diagram for schematically explaining the developing state of the developing device of the first embodiment of this invention.

In the main body 10, the eccentric cams 56Y–56BK of the developing devices 50Y–50BK push the backs of the housing cases 51Y–52BK against the springs 56Y–56BK by rotating at a specified angle in the arrow direction m, and the developing roller shafts 53Y–53BK are inserted into the developing roller shaft guides 32Y–32BK as shown in FIG. 10. Thus, the developing rollers 52Y–52BK are maintained in the ready state separating from the photosensitive belt 12 by about 1.0 mm.

Hereafter, when the image forming process is started and the development is made by, for example, the yellow (Y) developing device 50Y filled with an yellow (Y) toner, the eccentric cam 56Y is rotated and driven in the arrow direction m until its longitudinal direction becomes horizontal. As a result, the housing case 51Y is slid in the arrow direction n against the spring 57Y. The developing device 50Y in the housing case 51Y is slid in the arrow direction n in the state guided by the developing roller shaft guide 32Y and brings the developing roller 52Y to the photosensitive belt 12 to bite into the belt 12 by about 0.5 mm and becomes ready to make the development.

After completing the development, the eccentric cam 56Y is driven by rotating in the direction reverse to the arrow direction m to a position and stopped there as shown in FIG. 10. Thus, the developing device 50Y is slid by the spring 57Y together with the housing case 51Y in the direction reverse to the arrow direction n, and the developing roller 52Y is separated from the photosensitive belt 12 and returns to the ready state.

Figure 12:
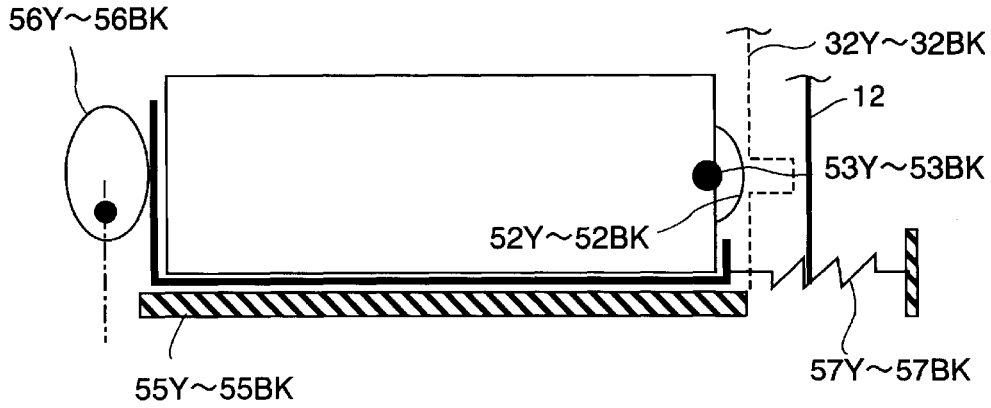
FIG. 12 is a diagram for schematically explaining the connection/disconnection of the developing device from the main body of the first embodiment of this invention.

Next, when supplying developers to the developing devices 50Y–50BK, after opening the front cover (not shown) of the main body 10, manually rotate the eccentric cams 56Y–56BK in the ready state in the direction reverse to the arrow direction m until their longitudinal directions become vertical. The developing devices 50Y–50BK are slid jointly with the housing cases 51Y–51BK further in the direction reverse to the arrow direction n by the springs 57Y–57BK and stop at the positions shown in FIG. 12. At this time, the developing roller shafts 53Y–53BK are out of the developing roller shaft guides 32Y–32BK and are in the free state without load by the eccentric cams 56Y–56BK and the springs 57Y–57 BK in the housing cases 51Y–51BK.

Hereafter, pull out the developing device 50Y–50BK from the housing cases 51Y–51BK along the guide rails (not shown) to the front side and return them into the housing cases after supplying developers. Then, rotate the eccentric cams 56Y–56BK in the arrow direction m manually from the free state shown in FIG. 12. By the rotation of the eccentric cams 56Y–56BK, the housing cases 51Y–51BK are slid in the arrow direction n against the springs 57Y–57BK and at the point of time when reaching the ready state shown in FIG. 10 wherein the developing roller shafts 53Y–53BK are inserted into the developing roller shaft guides 32Y–32BK, stop the rotation of the eccentric cams 56Y–56BK and closing the front cover (not shown), terminate the developer supply operation.

According to this third embodiment, the developing devices 50Y–50BK which are moved in the direction of the photosensitive belt 12 can be removed/connected from/to the housing cases 51Y–51BK at the front side likewise the first embodiment described above and therefore, the cover opening/closing operations are not impeded when removing/connecting the developing devices, the installing position is not restricted, the space saving can be achieved and furthermore, the developing devices are suited for use in a composite apparatus, etc. Further, when removing/connecting the developing devices 50Y–50BK from/to the housing cases 51Y–51BK, the developing devices 50Y–50BK are in the free state without load applied from the eccentric cams 56Y–57BK or the springs 57Y–57BK and can be removed/connected smoothly only by sliding them along the guide rails (not shown) in the front direction and thus, operability can be improved.

Further, this invention is not limited to the embodiments described above but can be modified variously within the spirit and scope of this invention. For example, a distance, etc. between a developing unit of a developing device and an image carrier are optional and in the free state wherein the developing device is taken out of the main body, a distance can be such that the developing unit does not contact an image carrier by the movement of manual moving operation of the developing device. Further, a distance between a developing unit and an image carrier in the ready state is not restricted when the developing device can be switched from the ready state to the developing state or from the developing state to the ready state while an interval of recording sheets of preceding latent image formed on the image carrier and a succeeding latent image passes but a distance of 0.5–3.0 mm is desirable.

Further, when a photosensitive belt is used for an image carrier as in the embodiments described above, it is desirable that a contact amount between the developing roller and the photosensitive belt in the development is also not restricted if a uniform and sufficient image density is obtained and within a satisfactory conveyable range without causing the movement of the photosensitive belt but it is desirable to bring the roller to bite into the belt by about of 0.2–3 mm.

Further, developers that are used for the developing devices are also not restricted and one-component developers or two-component developers can be used optionally.

Figure 13:
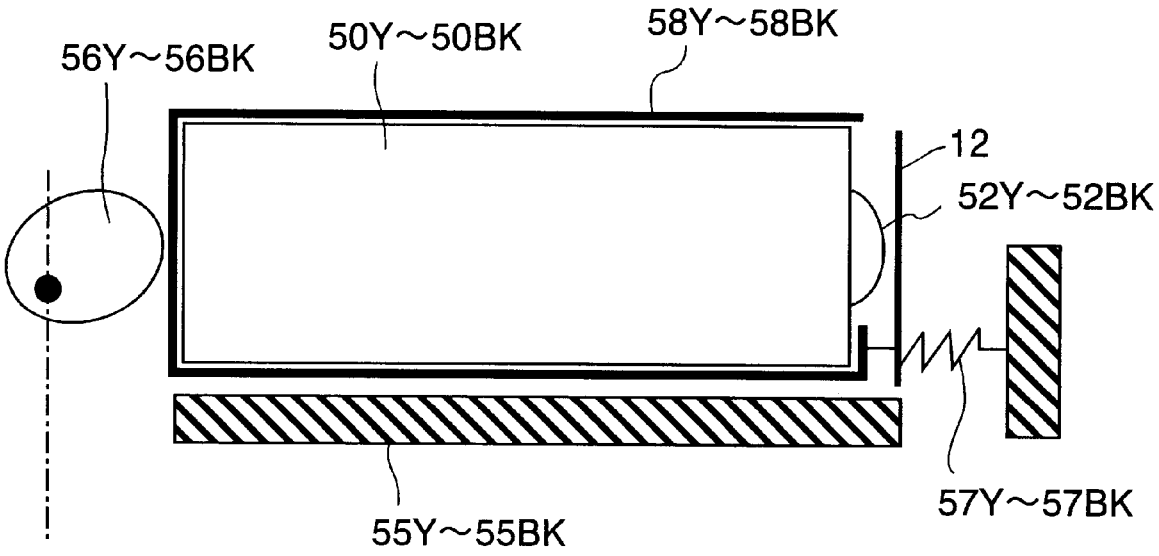
FIG. 13 is a schematic block diagram showing a developing device of another deformed example of this invention.

Further, the installing position of the driving gear in the first embodiment is also not restricted and the device may be driven by bringing it directly contact the top of the developing devices without providing the boards depending upon the arranging state of the developing devices, and also in the second embodiment, the driving gear may be driven by rotating it on the top of the casing of the developing device by forming a rack on the top of the casing. Further, the shapes of the housing cases in the third embodiment described above are also not restricted and may be supported optionally by, for example, the box-shaped housing cases 51Y–51BK as in the deformed example shown in FIG. 13. Further, an electromagnetic clutch, etc. may be used for the compression member.

As described above, according to this invention, it is possible to connect/separate the developing devices that are moved by sliding so as to contact/separate to/from an image carrier from the front side of the main body of an image forming apparatus and irrespective of the installing position of the main body of the apparatus or the system construction, etc. of the main body, the opening/closing operations of the cover of the main body of the apparatus when connecting/separating the developing devices are not impeded, the space saving can be achieved and furthermore, it becomes possible to arrange an optical device on the top of an image forming apparatus or to use in a composite apparatus equipped with a finish device, etc. on the side of the image forming apparatus. In addition, when the developing devices are connected or separated to/from the main body of the apparatus, load is not solely applied to the developing devices by the driving gears for moving the developing devices. Therefore, the developing devices are in the free state and users are able to easily connect/separate the developing devices only by sliding them in the front direction and thus, operability can be improved.

What is claimed is:

1. An image forming apparatus comprising:

an image carrier;

a latent image forming unit to form a latent image on the image carrier;

a developing device having a developing unit that supplies a developer to the latent image by sliding in a direction to contact/separate to/from the image carrier in a main body;

a positioning device to maintain the developing device in an operable state for the development in the main body; and a driving device to connect/separate the developing device to/from the positioning device by applying load in a sliding direction to the developing device and after connecting the developing device to the positioning device, move the developing device by sliding in a direction to contact/separate to/from the image carrier, wherein the driving device releases the load applied to the developing device after separating the developing device from the positioning device, wherein the connection/separation of the developing device to/from the main body is made from the front side of the main body that is orthogonal to the sliding direction.

2. The image forming apparatus according to claim 1, wherein the positioning device maintains the developing device in the operable state by supporting a shaft of the developing unit.

3. The image forming apparatus according to claim 1, wherein there are plural developing devices each of which supplies a developer in different color to the latent image.

4. The image forming apparatus according to claim 1, wherein the driving device is made of a rotary body comprising an acting portion provided around a shaft to contact the developing device and move it by sliding and a releasing portion that is formed by cutting a part of the acting portion and not in contact with the developing device.

5. The image forming apparatus according to claim 4, wherein the acting portion comprises a high frictional member and moves the developing device by the frictional force when contacting the developing device.

6. The image forming apparatus according to claim 4, wherein the acting portion is in a gear shape and when contacting the developing device, mechanically meshes with the developing device and moves it by sliding.

7. The image forming apparatus according to claim 1, wherein the driving device comprises a housing case to house the developing device and a housing case moving device to move the housing case by sliding.

8. An image forming apparatus comprising:

a photosensitive body;

a latent image forming unit to form a latent image on the photosensitive body;

a developing device having a developing roller which supplies a developer to the latent image by sliding in a direction to connect/separate to/from the photosensitive body in a main body;

a positioning member to maintain the developing device in an operable state in the main body; and a driving roller having an acting portion provided around a shaft in contact with the developing device for slidingly moving the developing device and a releasing portion that is formed by partially cutting the acting portion and not in contact with the developing device, to connect/separate the developing device to/from the positioning member by applying load to the developing device in a sliding direction in the main body and moving the developing device in a direction to separate from the photosensitive body;

wherein the releasing portion is brought to face the developing device after releasing the developing devices from the positioning device, wherein the developing device is connected/separated to/from the main body from a front side of the main body that is orthogonal to the sliding direction.

9. The image forming apparatus according to claim 8, wherein the positioning member maintains the developing device in the operable state by supporting a developing roller shaft of the developing roller.

10. The image forming apparatus according to claim 8, wherein there are plural developing devices each of which supplies a developer in different color to the latent image.

11. The image forming apparatus according to claim 8, wherein the acting portion is a partially cut rubber roller and moves the developing device by sliding by a frictional force of the rubber roller when contacting the developing device.

12. The image forming apparatus according to claim 8, wherein the acting portion is a partially cut gear roller and mechanically meshes with the developing device and moves the developing device when contacting the developing device.

13. An image forming apparatus comprising:

a photosensitive body;

a developing device having a developing roller which is slid in a direction to contact/separate to/from the photosensitive body and supplies a developer to the latent image;

a positioning member to maintain the developing device in an operable state for development in a main body;

a housing case for housing the developing device; and a housing case moving device which contacts the housing case, connects and releases the developing device to the positioning member by applying load in a sliding direction to the housing case and after connecting the developing device to the positioning member, moves the housing case and brings the developing device to contact/separate to/from the photosensitive body by sliding the housing case, wherein the developing device is connected or separated to/from the housing case from a front side of the main body that is orthogonal to the sliding direction.

14. The image forming apparatus according to claim 13, wherein the positioning member maintains the developing device in the operable state for development by supporting a developing roller shaft of the developing roller.

15. The image forming apparatus according to claim 13, wherein there are provided plural developing devices each of which supplies developers in different color, respectively.

16. The image forming apparatus according to claim 13, wherein the housing case moving device comprises a first pressing member to press the housing case in the direction to separate from the photosensitive body and a second pressing member to press the housing case to the photosensitive body side against the first pressing member.

17. The image forming apparatus according to claim 16, wherein either one of the first and second pressing members is made of an elastic member and the other is made of an eccentric cam.

* * * * *